US005120110A

United States Patent [19]

Tseng

[11] Patent Number: 5,120,110

[45] Date of Patent: Jun. 9, 1992

[54] LAWN CHAIR

[75] Inventor: Chuen-Jong Tseng, Chiayi Hsien, Taiwan

[73] Assignee: Shin Yeh Enterprise Co., Ltd., Taiwan

[21] Appl. No.: 694,449

[22] Filed: May 1, 1991

[51] Int. Cl.[5] ..... A47C 1/12

[52] U.S. Cl. ..... 297/445; 297/463

[58] Field of Search ..... 297/445, 463, 440, 442, 297/419; 40/5; 24/297

[56] References Cited

U.S. PATENT DOCUMENTS

| | | | |
|---|---|---|---|
| 2,193,719 | 3/1940 | Foote | 297/463 X |
| 3,054,643 | 9/1962 | Militano | 297/463 |
| 3,590,754 | 7/1971 | Jakobsen | 297/463 X |
| 3,677,601 | 7/1972 | Morrison | 297/445 X |
| 4,453,324 | 6/1984 | Greenberger | 40/5 |
| 4,919,487 | 4/1990 | Gibbs | 297/445 |

FOREIGN PATENT DOCUMENTS

| | | | |
|---|---|---|---|
| 646148 | 11/1928 | France | 297/445 |

*Primary Examiner*—Laurie K. Cranmer
*Attorney, Agent, or Firm*—Ladas & Parry

[57] ABSTRACT

A predetermined portion of the frame of a lawn chair is provided with at least one elongated dovetail-like groove. A flexible decorative strip is press fitted into and retained within the dovetail-like groove.

2 Claims, 3 Drawing Sheets

LAWN CHAIR

BACKGROUND OF THE INVENTION

1. Field of the Invention

The invention relates to a lawn chair, more particularly to a lawn chair having enhanced aesthetic effects.

2. Description of the Related Art

Referring to FIG. 1, a conventional lawn chair is shown to comprise a chair frame 1 having an armrest portion 11, a back rest portion 12, chair legs 13 and a seat portion 14. The back rest portion 12 and the seat portion 14 are provided with a plurality of spaced flexible plastic straps 241.

The entire chair frame 1 is made of a single material, such as metal or plastic. The surface of the chair frame 1 may be flat or engraved, and is coated with a layer of paint. The conventional lawn chair frame 1 is thus dull looking since only one color can be seen.

SUMMARY OF THE INVENTION

Therefore, the main objective of the present invention is to provide a lawn chair construction having enhanced aesthetic effects.

Accordingly, a lawn chair of the present invention comprises a chair frame having a U-shaped armrest portion with two parallel horizontal side portions and a horizontal connecting portion interconnecting rear ends of the horizontal side portions, and two parallel vertical legs respectively extending downward from front ends of the horizontal side portions. At least one elongated dovetail-like groove is formed in an upper surface of the armrest portion and on front surfaces of the vertical legs. A flexible decorative strip is press fitted into and retained within the dovetail-like groove.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
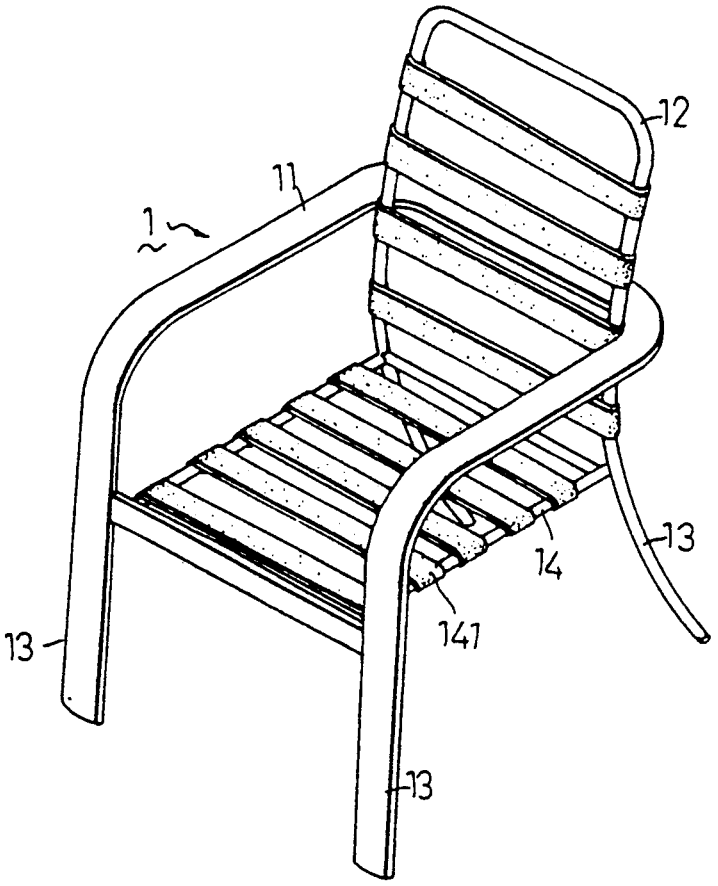
PRIOR ART FIG. 1
FIG. 1 is a perspective view of a conventional lawn chair.
Figure 2:
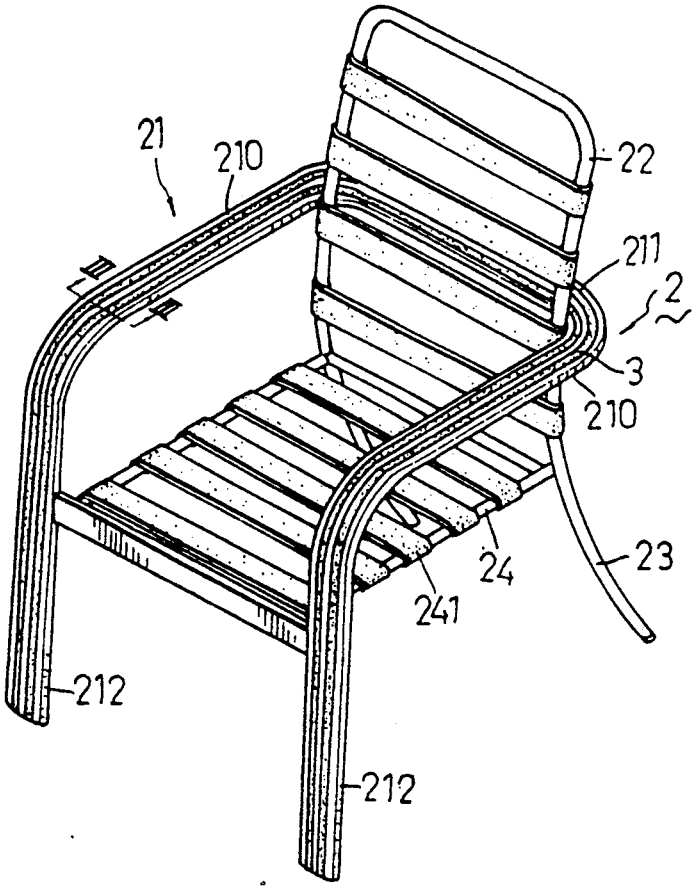
FIG. 2 is a perspective view of the first preferred embodiment of a lawn chair according to the present invention.
Figure 3:
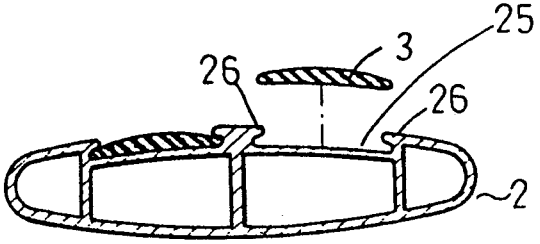
FIG. 3 is a sectional view of an armrest portion of the first preferred embodiment.

Referring to FIGS. 2 and 3, the first preferred embodiment of a lawn chair according to the present invention is shown to mainly comprise a chair frame 2 and a pair of decorative strips 3.

The chair frame 2 includes a U-shaped armrest portion 21, a back rest portion 22, a pair of vertical front legs 212, a pair of rear legs 23, and a seat portion 24. The back rest portion 22 and the seat portion 24 are each provided with a plurality of spaced flexible plastic straps 241. The armrest portion 21 has two parallel horizontal side portions 210 and a horizontal connecting portion 211 interconnecting rear ends of the horizontal side portions 210. The front legs 212 respectively extend downward from front ends of the horizontal side portions 210. A pair of spaced elongated dovetail-like grooves 25 is formed on an upper surface of the armrest portion 21 and on front surfaces of the front legs 212. The decorative strips 3 are preferably made of a flexible material and are press fitted into the dovetail-like grooves 25. A pair of elongated inward and oppositely extending flanges 26 project into each dovetail-like groove 25 at an outermost end of the dovetail-like groove 25 to retain the decorative strips 3 within the grooves 25.

Removal of the decorative strips 3 from the dovetail-like grooves 25 can be easily accomplished by gradually pulling the extreme end of one decorative strip 3 away from the respective dovetail-like groove 25. A new set of decorative strips 3 can then be inserted in the dovetail-like grooves 25, the style of which may be suited to the user's taste.

Figure 4:
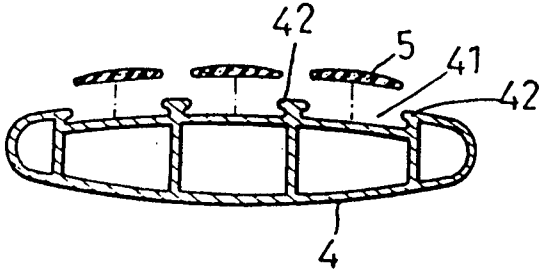
FIG. 4 is a sectional view of a predetermined portion of the second preferred embodiment of a lawn chair according to the present invention.

Referring to FIG. 4, a predetermined portion 4 of the chair frame of the second preferred embodiment is formed with three spaced elongated dovetail-like grooves 41 to receive three flexible decorative strips 5. As with the first preferred embodiment, a pair of elongated inward and oppositely extending flanges 42 project into each dovetail-like groove 41 at an outermost end of the dovetail-like groove 41 to retain the decorative strips 3 within the grooves 41. The construction and assembly of the second preferred embodiment is very similar to that of the first preferred embodiment and will not be detailed further.

Figure 5:
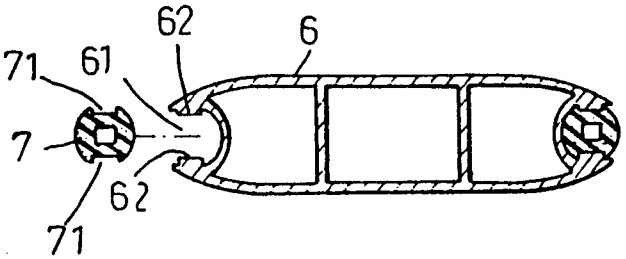
FIG. 5 is a sectional view of a predetermined portion of the third preferred embodiment of a lawn chair according to the present invention.

Referring to FIG. 5, a predetermined portion 6 of the chair frame of the third preferred embodiment is substantially oblongated in cross-section and has two curved sides. An elongated dovetail-like groove 61 is formed at each curved side of the predetermined portion 6 to receive a flexible decorative strip 7. As with the first and second preferred embodiments, a pair of elongated inward and oppositely extending flanges 62 project into each dovetail-like groove 61. The decorative strip 7 is formed with a pair of oppositely disposed elongated slots 71 to engage the flanges 62. The construction and assembly of the third preferred embodiment is also substantially similar to that of the first preferred embodiment and will not be detailed further.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A lawn chair comprising a chair frame including a U-shaped armrest portion with two parallel horizontal side portions and a horizontal connecting portion interconnecting rear ends of the horizontal side portions and two parallel vertical legs respectively extending downward from front ends of said horizontal side portions, at least one elongated dovetail-like groove being formed on an upper surface of said armrest portion and on front surfaces of the vertical legs, and a flexible decorative strip being pressingly fitted into the dovetail-like groove and retained therein by flanges of the groove.

2. A lawn chair comprising a chair frame including a U-shaped armrest portion with two parallel horizontal side portions and a horizontal connecting portion interconnecting rear ends of said horizontal side portions, and two parallel vertical legs respectively extending downward from front ends of said horizontal side portions, said chair frame being of a substantially oblong cross-section and having two curved sides, at least one dovetail-like groove being formed in one of said curved sides, and a flexible decorative strip being pressingly fitted into the dovetail-like groove and retained therein by flanges of the groove.

* * * * *